US009449739B2

(12) United States Patent
Gao et al.

(10) Patent No.: US 9,449,739 B2
(45) Date of Patent: Sep. 20, 2016

(54) HIGH POWER, HIGH FREQUENCY POWER CABLE

(71) Applicant: THE BOEING COMPANY, Chicago, IL (US)

(72) Inventors: Lijun Gao, Kent, WA (US); Shengyi Liu, Sammamish, WA (US)

(73) Assignee: THE BOEING COMPANY, Chicago, IL (US)

( * ) Notice: Subject to any disclaimer, the term of this patent is extended or adjusted under 35 U.S.C. 154(b) by 269 days.

(21) Appl. No.: 13/652,959

(22) Filed: Oct. 16, 2012

(65) Prior Publication Data

US 2014/0102781 A1 Apr. 17, 2014

(51) Int. Cl.
*H01B 7/42* (2006.01)
*H01B 9/04* (2006.01)

(52) U.S. Cl.
CPC ..... *H01B 7/428* (2013.01); *H01B 9/04* (2013.01)

(58) Field of Classification Search
CPC ..... H01B 9/04; H01B 7/428
USPC ..... 174/70 R, 110 R, 110 SR, 102 R, 126.4, 174/107; 703/2
See application file for complete search history.

(56) References Cited

U.S. PATENT DOCUMENTS 3,193,712 A * 7/1965 Harris ..... 307/147
3,261,907 A * 7/1966 Morrison ..... 174/115
3,509,266 A * 4/1970 Endacott ..... 174/15.6
3,692,925 A * 9/1972 Kindij ..... 174/120 C
3,946,142 A 3/1976 Kellow et al.
4,039,740 A * 8/1977 Iwata ..... 174/15.5
5,326,604 A * 7/1994 Williamson ..... 428/36.2
5,864,094 A * 1/1999 Griffin ..... 174/105 R
6,509,521 B1 * 1/2003 Geitz ..... 174/28
6,750,399 B1 * 6/2004 Daumling ..... 174/102 R
7,081,586 B2 7/2006 Rehrig
7,750,240 B2 * 7/2010 Jiang et al. ..... 174/102 R (Continued)

FOREIGN PATENT DOCUMENTS

CN 101499331 A 8/2009
CN 201465640 U 5/2010

(Continued)

OTHER PUBLICATIONS

University of Alaska, Fairbanks, "What Is a Superconductor", Sep. 25, 2012, http://ffden-2.phys.uaf.edu/113.web.stuff/travis/what_is.html.*

(Continued)

*Primary Examiner* — Hoa C Nguyen
*Assistant Examiner* — Keith Depew
(74) *Attorney, Agent, or Firm* — Vista IP Law Group LLP; Cynthia A. Dixon

(57) ABSTRACT

The present disclosure provides a power cable apparatus that comprises an elongated thermal conductor, and an electrical conductor layer surrounding at least a portion of the elongated thermal conductor. In one or more embodiments, heat generated in the power cable is transferred via the elongated thermal conductor to at least one end of the power cable. In at least one embodiment, the apparatus further comprises an electric insulation layer surrounding at least a portion of the electrical conductor layer. In some embodiments, the apparatus further comprises a thermal insulation layer surrounding at least a portion of the electric insulation layer.

23 Claims, 9 Drawing Sheets

(56) References Cited

U.S. PATENT DOCUMENTS

| | | | | |
|---|---|---|---|---|
| 8,604,340 | B2 * | 12/2013 | Jiang et al. | 174/36 |
| 8,658,897 | B2 * | 2/2014 | Doneker et al. | 174/105 R |
| 8,847,074 | B2 * | 9/2014 | Mann et al. | 174/102 SC |
| 2005/0023029 | A1 * | 2/2005 | Mammeri et al. | 174/121 A |
| 2005/0167150 | A1 * | 8/2005 | Studer | 174/113 R |
| 2006/0175078 | A1 * | 8/2006 | Yumura et al. | 174/125.1 |
| 2006/0260837 | A1 * | 11/2006 | Manousiouthakis et al. | 174/125.1 |
| 2008/0047727 | A1 * | 2/2008 | Sexton et al. | 174/36 |
| 2008/0190646 | A1 * | 8/2008 | Folts et al. | 174/125.1 |
| 2009/0194313 | A1 | 8/2009 | Jiang et al. | |
| 2009/0255706 | A1 * | 10/2009 | Jiang et al. | 174/102 R |
| 2010/0307811 | A1 * | 12/2010 | Griffin | 174/350 |
| 2011/0174519 | A1 * | 7/2011 | Shah et al. | 174/119 C |
| 2012/0000691 | A1 * | 1/2012 | Shah et al. | 174/102 R |
| 2012/0091144 | A1 * | 4/2012 | Baumgartner et al. | 220/560.04 |
| 2012/0181059 | A1 * | 7/2012 | Radermacher et al. | 174/115 |
| 2012/0186851 | A1 * | 7/2012 | Winterhalter et al. | 174/113 C |
| 2012/0234577 | A1 * | 9/2012 | Kim et al. | 174/113 R |

FOREIGN PATENT DOCUMENTS

| | | | |
|---|---|---|---|
| CN | 201910284 | U | 7/2011 |
| EP | 1624396 | A1 | 2/2006 |
| WO | 2009039872 | A1 | 4/2009 |

OTHER PUBLICATIONS

Extended European Search Report, EU Patent Application No. 13188741.6-1903/2722854, May 4, 2016.

First Office Action, CN Patent Application No. 201310483305.8, Jun. 2, 2016.

* cited by examiner

HIGH POWER, HIGH FREQUENCY POWER CABLE

FIELD

The present disclosure relates to power cables. In particular, it relates to high power, high frequency power cables.

BACKGROUND

Currently, for conventional power cable designs, heat is released from the power cable along the surface of the cable. As such, a bulky space cooling system is required for these conventional power cable designs to maintain the power cable's temperature below a maximum temperature threshold. The present disclosure provides a cable design that allows for an efficient use of materials, and provides for efficient heat dissipation, while at the same time is suitable for high power transfer and high frequency power transmission.

SUMMARY

The present disclosure relates to a method, system, and apparatus for a high power, high frequency power cable. In one or more embodiments, the present disclosure teaches a power cable apparatus that comprises an elongated thermal conductor. The power cable apparatus further comprises an electrical conductor layer surrounding at least a portion of the elongated thermal conductor. In at least one embodiment, heat generated in the power cable is transferred via the elongated thermal conductor to at least one end of the power cable.

In one or more embodiments, the power cable apparatus further comprises an electric insulation layer surrounding at least a portion of the electrical conductor layer.

In at least one embodiment, the electric insulation layer is manufactured from polyvinylchloride (PVC), fluoroethylenepropylene (FEP), or polytetrafluorethylene (TFE) Teflon.

In some embodiments, the power cable apparatus further comprises a thermal insulation layer surrounding at least a portion of the electric insulation layer.

In one or more embodiments, the apparatus further comprises a shielding layer surrounding at least a portion of the electric insulation layer. In at least one embodiment, the apparatus further comprises a second electric insulation layer surrounding at least a portion of the shielding layer.

In at least one embodiment, the apparatus further comprises a second thermal conductor layer surrounding at least a portion of the electrical conductor layer. In some embodiments, the apparatus further comprises an electric insulation layer surrounding at least a portion of the second thermal conductor layer. In at least one embodiment, the apparatus further comprises a thermal insulation layer surrounding at least a portion of the electric insulation layer.

In one or more embodiments, the cross section shape of the elongated thermal conductor is circular, rectangular, or polygonic. In at least one embodiment, the elongated thermal conductor is manufactured from a material that is flexible, light weight, and has a very high thermal conductivity. In some embodiments, the elongated thermal conductor is manufactured from pyrolytic graphite or carbon nanotubes (CNTs).

In one or more embodiments, the electrical conductor layer comprises a single solid or multiple strands. In some embodiments, the electrical conductor layer is manufactured from copper alloys; aluminum alloys; or a combination of copper, iron, and silver alloys. In some embodiments, at least one of the ends of the power cable is connected to a cooling system.

In one or more embodiments, a power distribution system is disclosed. The power distribution system comprises at least one power cable. At least one power cable comprises an elongated thermal conductor, and an electrical conductor layer surrounding at least a portion of the elongated thermal conductor. In at least one embodiment, heat generated in the power cable is transferred via the elongated thermal conductor to at least one end of the power cable(s). In some embodiments, the power distribution system further comprises at least one cooling system connected to at least one of the ends of at least one power cable.

In at least one embodiment, at least one power cable further comprises an electric insulation layer surrounding at least a portion of the electrical conductor layer. In some embodiments, at least one power cable further comprises a thermal insulation layer surrounding at least a portion of the electric insulation layer.

In one or more embodiments, at least one power cable further comprises a shielding layer surrounding at least a portion of the electric insulation layer. In at least one embodiment, at least one power cable further comprises a second electric insulation layer surrounding at least a portion of the shielding layer.

In at least one embodiment, at least one power cable further comprises a second thermal conductor layer surrounding at least a portion of the electrical conductor layer. In some embodiments, at least one power cable further comprises an electric insulation layer surrounding at least a portion of the second thermal conductor layer. In at least one embodiment, at least one power cable further comprises a thermal insulation layer surrounding at least a portion of the electric insulation layer.

In one or more embodiments, a method of cooling a power cable is disclosed. The method comprises providing, for the power cable, an elongated thermal conductor. The method further comprises providing, for the power cable, an electrical conductor layer surrounding at least a portion of the elongated thermal conductor. In addition, the method comprises transferring heat generated in the power cable via the elongated thermal conductor to at least one end of the power cable.

In at least one embodiment, a method for generating specifications for a power cable comprises providing, to at least one computer, requirements, conditions, and constraints for the power cable. In one or more embodiments, the requirements comprise electrical requirements for the power cable, the conditions comprise materials of manufacture for the power cable, and the constraints comprise temperature constraints for the power cable. The method further comprises generating, with at least one computer, a set of coupled electrical-thermal steady-state algorithms for the power cable by using the provided requirements, conditions, and constraints for the power cable. Further, the method comprises calculating, with at least one computer, the specifications for the power cable by using the set of coupled electrical-thermal steady-state algorithms for the power cable.

The features, functions, and advantages can be achieved independently in various embodiments of the present inventions or may be combined in yet other embodiments.

DRAWINGS

These and other features, aspects, and advantages of the present disclosure will become better understood with regard to the following description, appended claims, and accompanying drawings where:

Figure 3A:
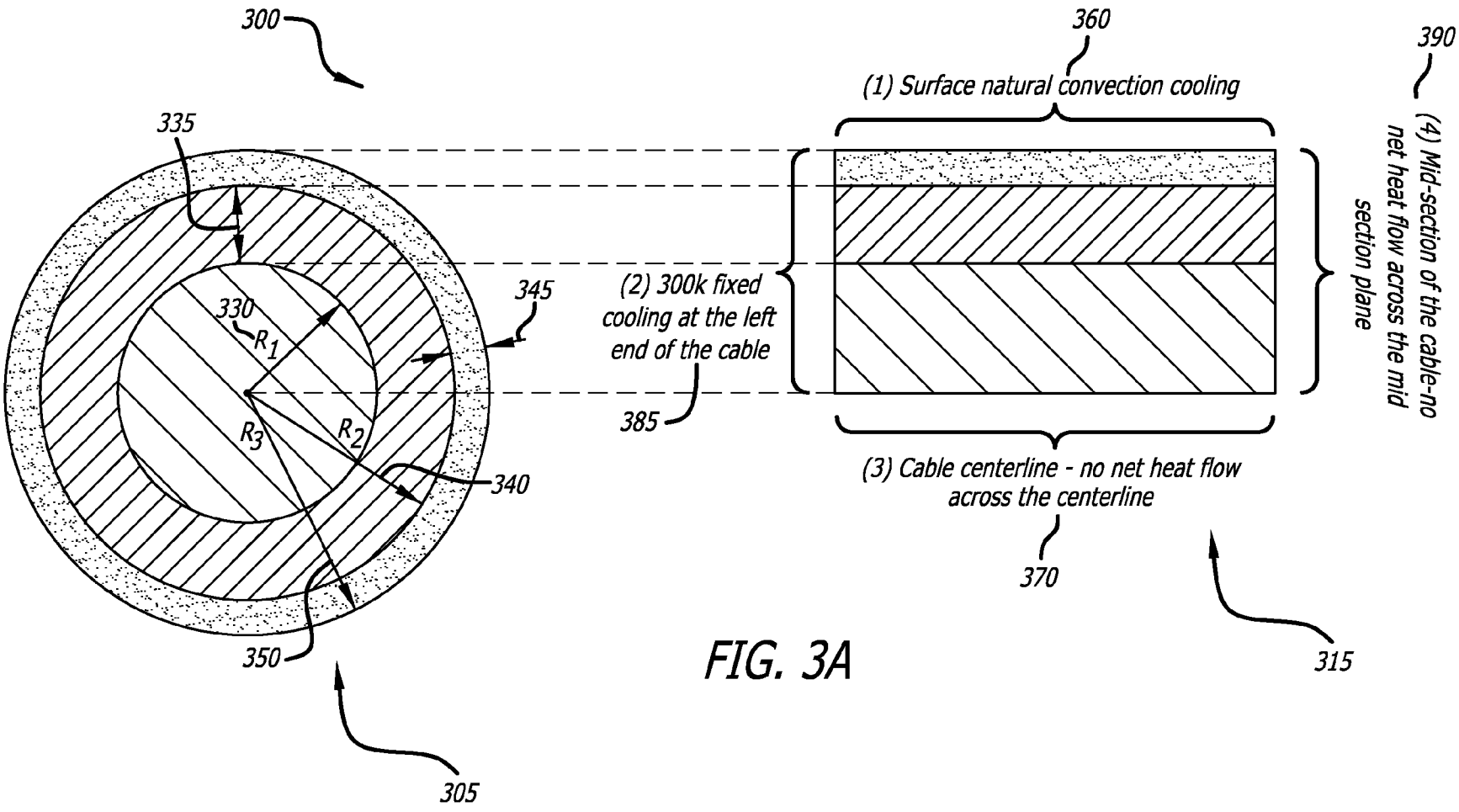

FIG. 3A is a schematic diagram of an exemplary design for the disclosed high power, high frequency power cable showing both the radial-direction cross-sectional view and the axial-direction cross-sectional view, in accordance with at least one embodiment of the present disclosure. In the axial-direction cross-sectional view, only the upper half of the left half of the cable is shown due to the fact that the cable is thermally symmetric about the axial centerline along the cable, and also about the radial-direction cross-sectional plane at the mid-point of the cable. In this figure, the boundary conditions for the cable performance simulation are specified.

Figure 3B:
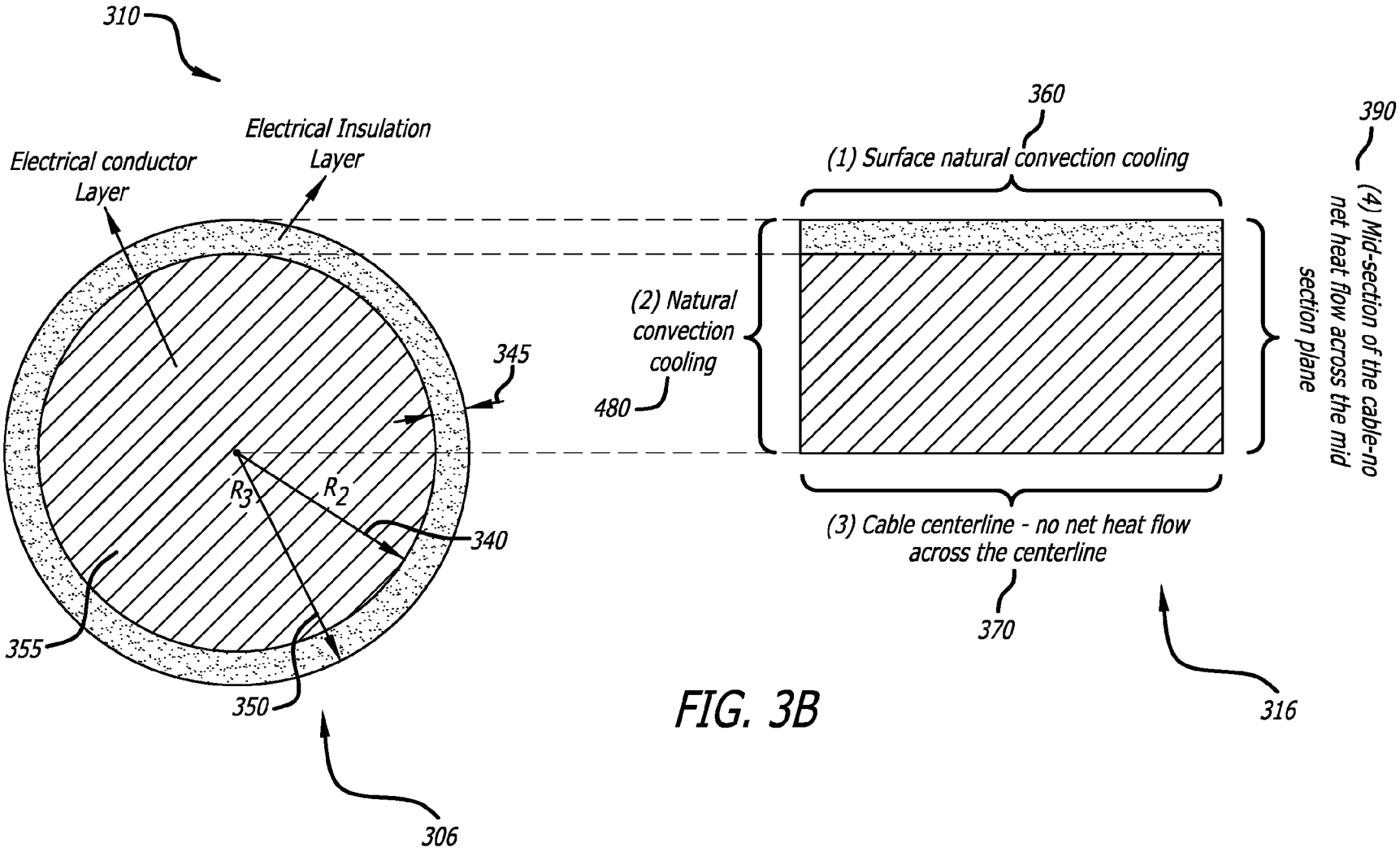

FIG. 3B is a schematic diagram of a conventional single solid conductor cable with an electric insulation layer showing both the radial-direction cross-sectional view and the axial-direction cross-sectional view. In this axial-direction cross-sectional view, only the upper half of the left half of the cable is shown due to the fact that the cable is thermally symmetric about the axial centerline along the cable, and also about the radial-direction cross-sectional plane at the mid-point of the cable. In this figure, the boundary conditions for the cable performance simulation are specified.

Figure 4:
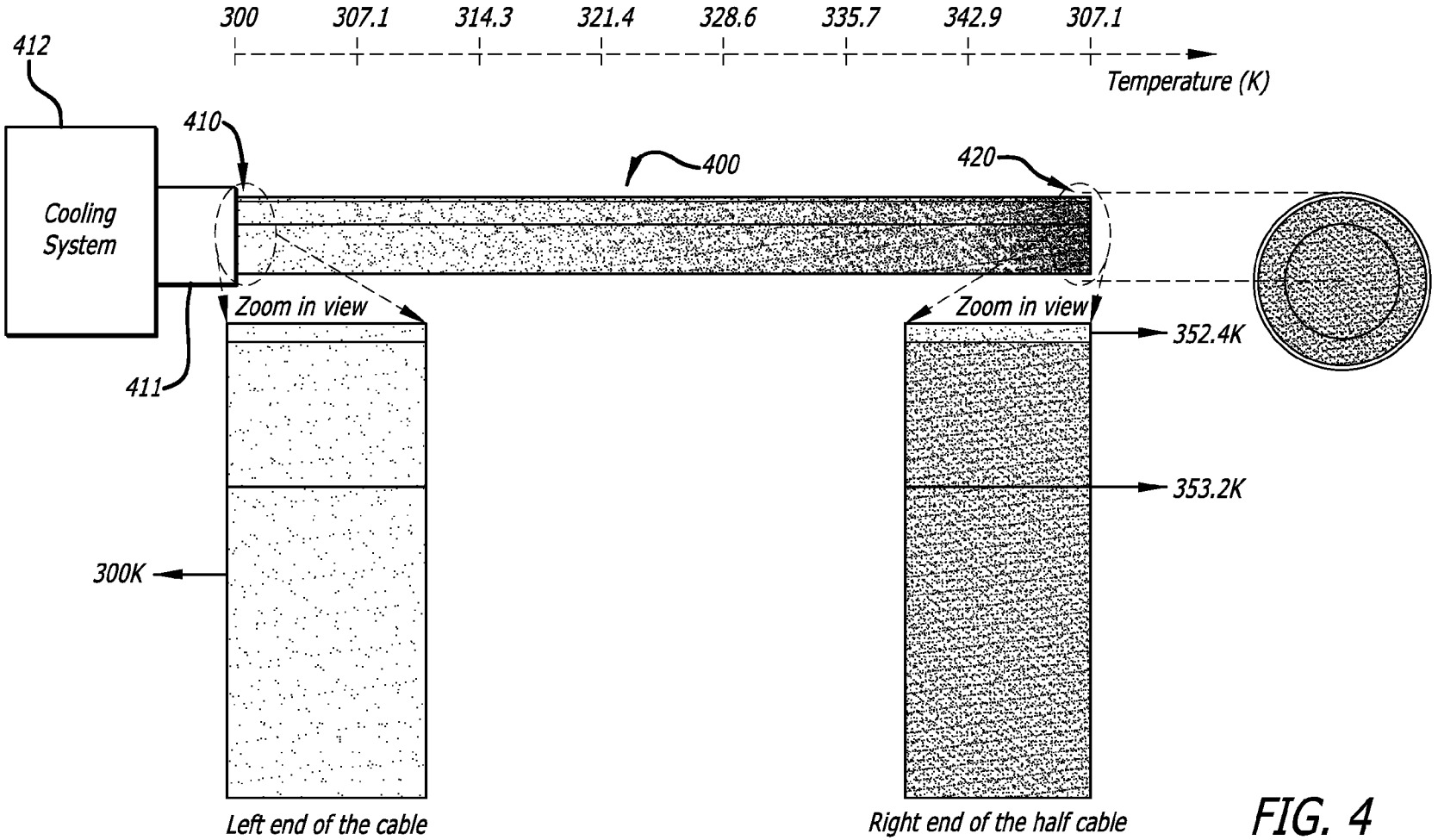

FIG. 4 is a schematic diagram showing the temperature distribution of the left half of the disclosed high power, high frequency power cable of FIG. 3A, in accordance with at least one embodiment of the present disclosure.

Figure 5:
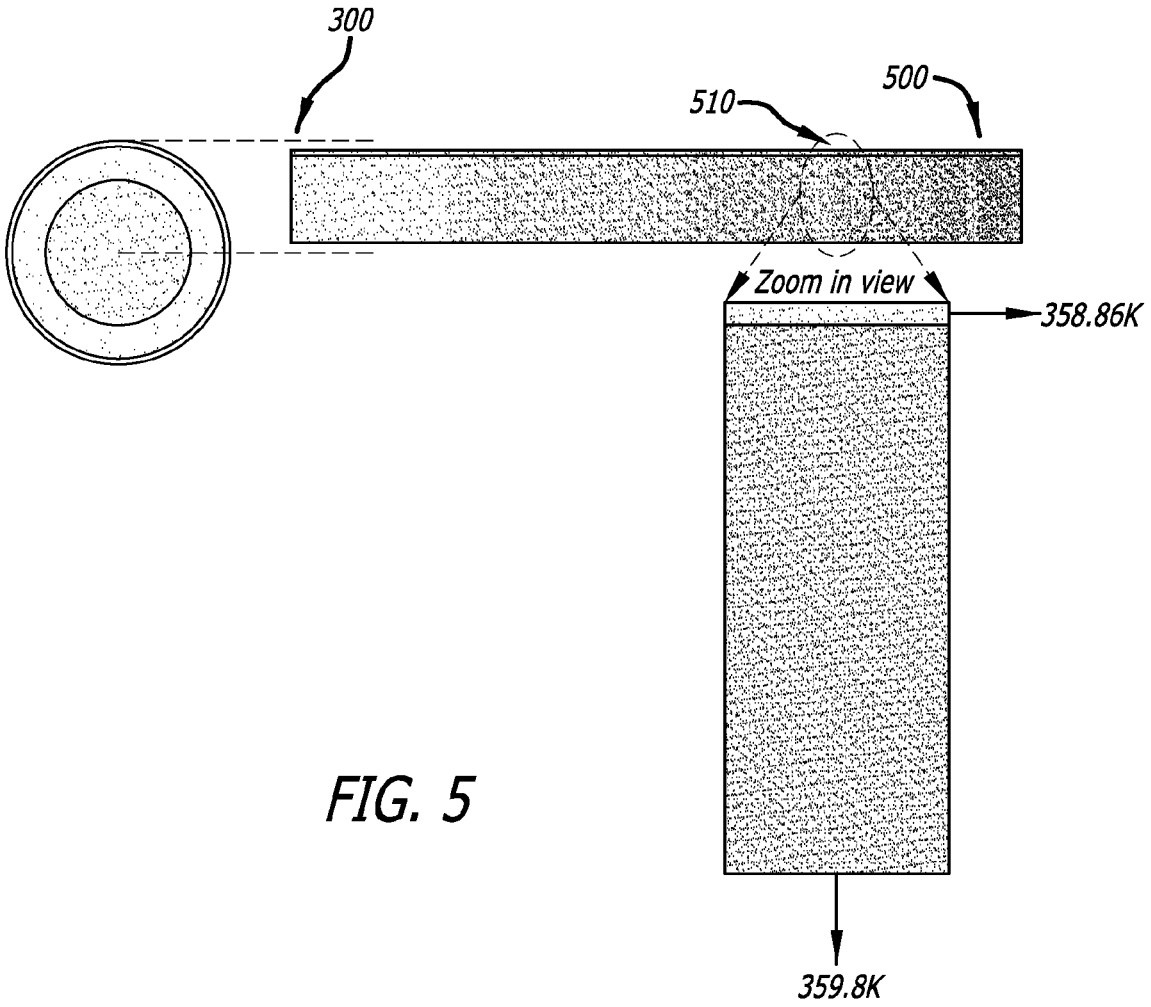

FIG. 5 is a schematic diagram showing the temperature distribution of the conventional cable of FIG. 3B.

Figure 6A:
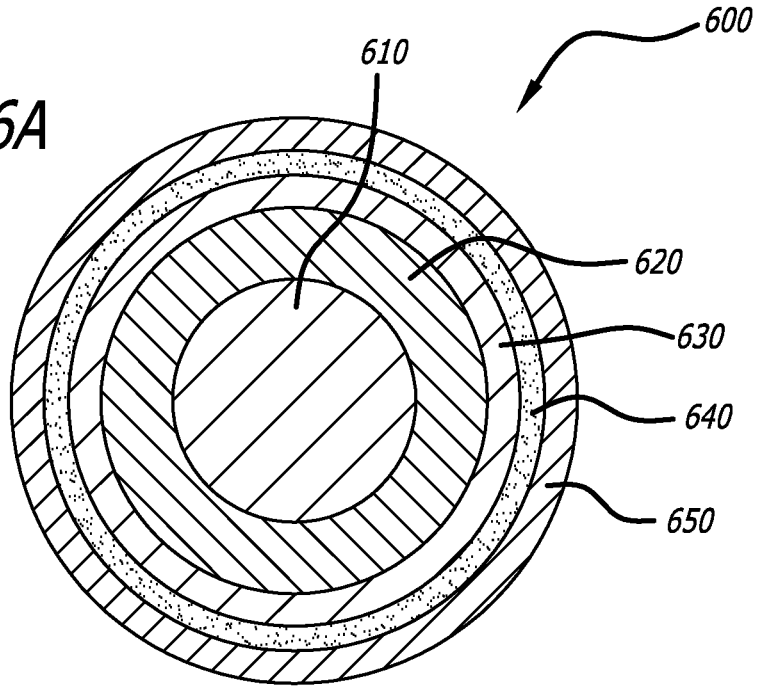

FIG. 6A is a cross-sectional end view depicting the different layers of another embodiment of the disclosed high power, high frequency power cable, in accordance with at least one embodiment of the present disclosure.

Figure 6B:
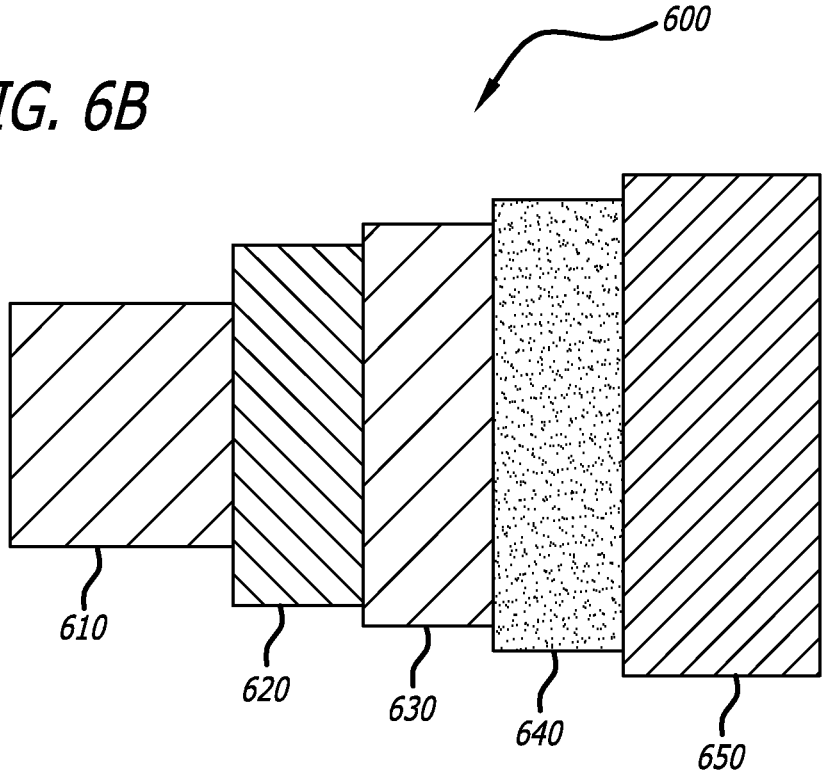

FIG. 6B is a cross-sectional side view depicting the different layers of the disclosed high power, high frequency power cable of FIG. 6A, in accordance with at least one embodiment of the present disclosure.

Figure 7A:
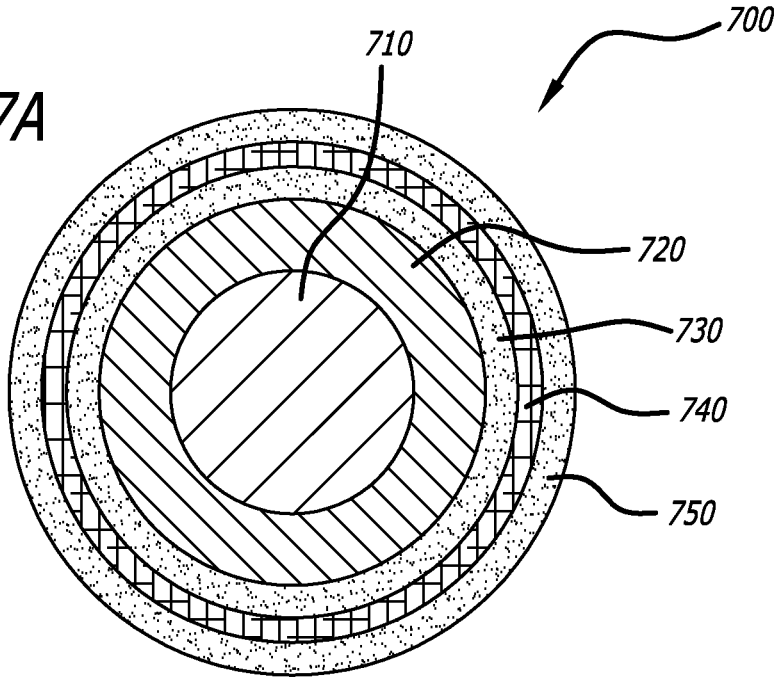

FIG. 7A is a cross-sectional end view depicting the different layers of yet another embodiment of the disclosed high power, high frequency power cable, in accordance with at least one embodiment of the present disclosure.

Figure 7B:
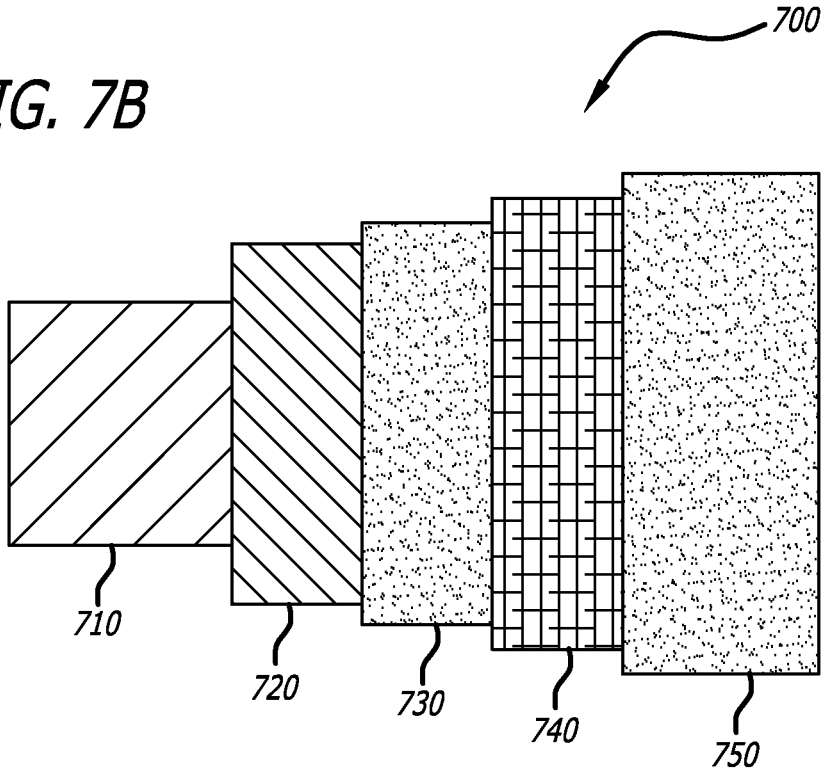

FIG. 7B is a cross-sectional side view depicting the different layers of the disclosed high power, high frequency power cable of FIG. 7A, in accordance with at least one embodiment of the present disclosure.

Figure 8:
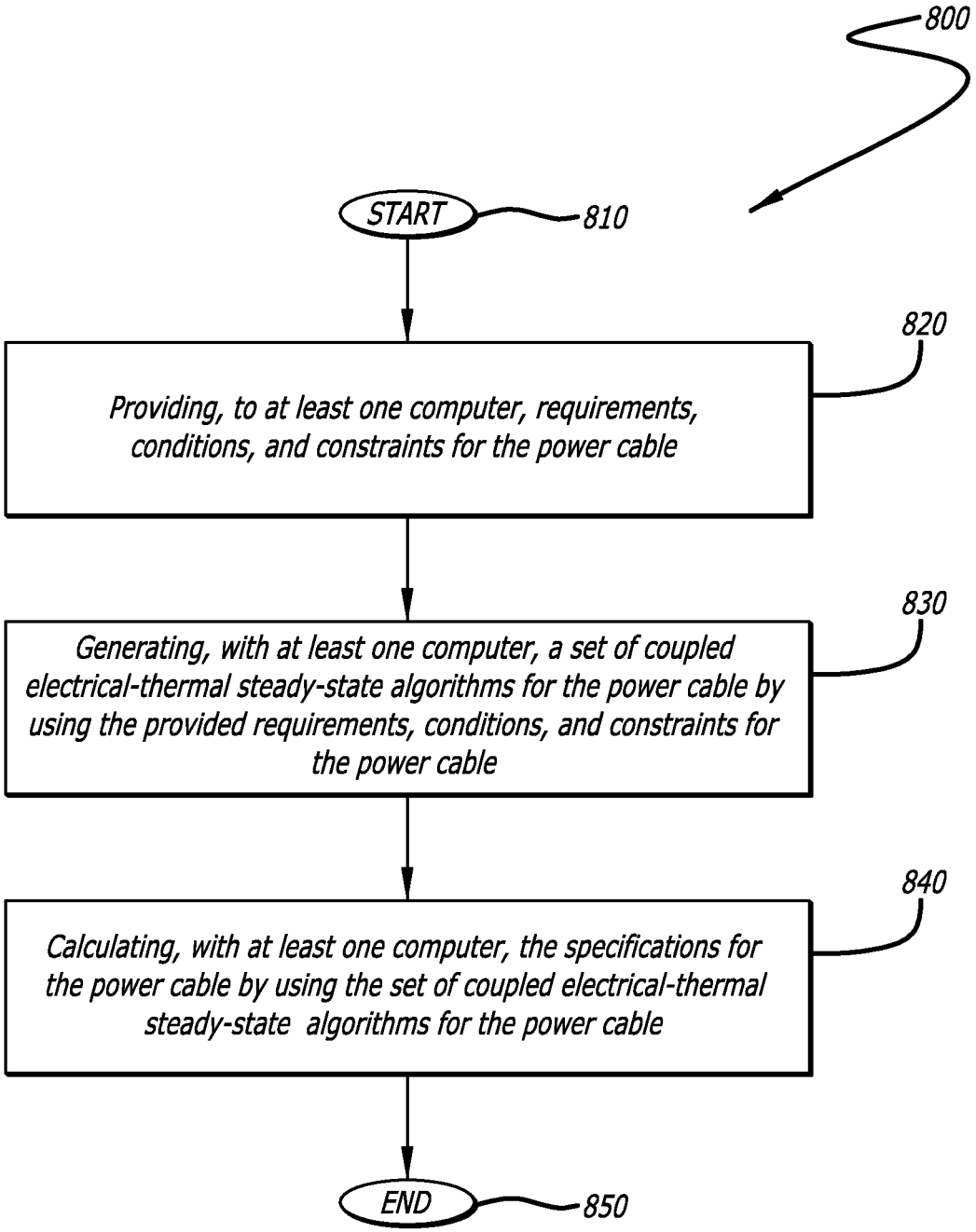

FIG. 8 is a flow chart of the disclosed method for generating specifications for a high power, high frequency power cable, in accordance with at least one embodiment of the present disclosure.

DESCRIPTION

The methods and apparatus disclosed herein provide an operative system for a high power, high frequency power cables. Specifically, this system employs a power cable design that comprises a multi-layer concentric structure that allows for heat to be removed from the power cable via one or both ends of the power cable. The multi-layer concentric structure of the disclosed power cable design includes an elongated central thermal conductor, an electric conductor layer surrounding the elongated thermal conductor, an electric insulation layer surrounding the electric conductor layer, and an optional layer of thermal insulation surrounding the electric insulation layer.

In one or more embodiments, the power cable design employs a cylindrical shaped electric conductor. The cylindrical design of the electric conductor allows for a minimization of the usage of metallic material, while taking into account a high frequency alternating current (AC) current skin effect. The center elongated thermal conductor may be manufactured from various materials that exhibit flexibility, are light weight, and exhibit very high thermal conductivity. Types of materials that the center elongated thermal conductor may be manufactured from include, but are not limited to, pyrolytic graphite and carbon nanotubes (CNTs).

The disclosed power cable design allows for heat in the power cable to be transported via the central elongated thermal conductor to at least one of the ends of the power cable. The central elongated thermal conductor is manufactured from materials of ultra-high thermal conductivity, which are higher in thermal conductivity than metal conductors, thereby allowing for the dissipation of heat from at least one of the power cable's ends. The electric conductor layer maximizes the utilization of the conductor materials by taking into account the skin effect, thereby lowering the weight of the power cable. For some applications, an outer thermal insulation layer is employed for the disclosed power cable. This optional outer thermal insulation layer prevents heat dissipation into ambient air through the power cable's surface. Since the heat produced from the power cable is removed from the power cable via at least one end of the power cable, the end(s) of the power cable are able to provide for an easy interface to a cooling system.

The disclosed power cable design can be used for a wide variety of applications. Types of applications that may be used for the disclosed power cable design include, but are not limited to, aircraft power distribution systems and other industrial applications where high power, high frequency, power cables are utilized. Design analysis shows that the disclosed cable design, as compared to a conventional cable design, can reduce the overall weight by 30% and reduce aluminum metal usage by 54%, while keeping the same electric current conducting capacity.

The present disclosure provides a solution for lowering the temperature of a high power, high frequency power cable. The temperature of a loaded power cable can get very hot due to conductor ohmic heating. High frequency, alternating current (AC) increases the temperature due to a skin effect. The high temperature causes a degraded current capacity of the power cable, causes acceleration in power cable insulation aging, and can be harmful to the surrounding equipment and structures. The heat released from the power cable into a closed area, such as that of aircraft electric equipment bays or in a building, adds a significant heat load to the environmental control system.

Aircraft power distribution systems require high power, high frequency, low weight, easily cooled, and relatively short power cables. Typically, aircraft electric power distribution systems operate from kilowatts to megawatts of power. The frequencies of AC current range from hundreds of Hertz (Hz) to thousands of Hz. The length of the power cable is typically from a few feet to hundreds of feet. The power cables utilized by aircraft power distribution systems, during operation, can be heated to up to one hundred degrees Celsius in temperature due to ohmic and skin effect losses. The high temperature lowers the current capacity of the power cable, and may be harmful to the power cable supports and nearby aircraft fuselage frame that are made of composite materials. Heat dissipation into the environment adds an extra heat load the environmental control system, which consumes more fuel, thereby lowering the system efficiency.

As previously mentioned, for current conventional power cable designs, heat is released from the power cable along the surface of the cable. As such, a bulky space cooling system is required for these conventional power cable designs to maintain the power cable's temperature below a maximum temperature threshold.

Conventional cable designs typically use either a single solid conductor or multi-stranded conductors, or a combination of both, with multi-stranded conductors surrounding a solid conductor. However, all of these conventional cables are heavy in weight, and do not provide for efficient heat dissipation.

One typical power cable cooling method used in industry involves circulating a cooled liquid, such as water or oil, through pipes that are run in close proximity to the power cable. In this case, heat is removed from the outer surface of the power cable. This particular approach has the disadvantages of having a high volume and weight penalty. Another typical power cable cooling method used in industry involves a space cooling system, such as an air-conditioning system. For this approach, the power cable is housed in an enclosed area that is cooled by a space cooling system. The space cooling system has the disadvantages of being bulky and heavy. As such, to better serve the needs of industry, the system and method of the present disclosure provide a cable design that allows for an efficient use of materials and that provides for efficient heat dissipation, while at the same time is suitable for high power transfer and high frequency power transmission.

In the following description, numerous details are set forth in order to provide a more thorough description of the system. It will be apparent, however, to one skilled in the art, that the disclosed system may be practiced without these specific details. In the other instances, well known features have not been described in detail so as not to unnecessarily obscure the system.

Figure 1A:
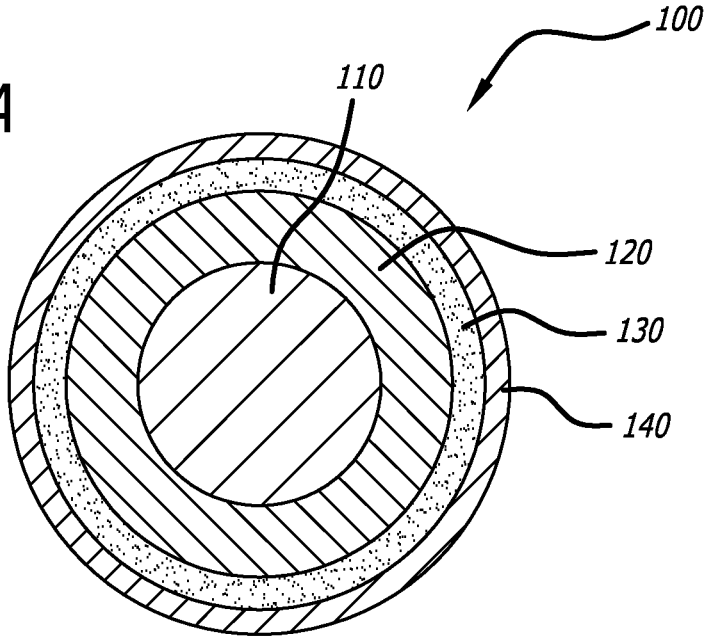
FIG. 1A is a cross-sectional end view depicting the different layers of the disclosed high power, high frequency power cable, in accordance with at least one embodiment of the present disclosure.

FIG. 1A is a cross-sectional end view depicting the different layers of the disclosed high power, high frequency power cable 100, in accordance with at least one embodiment of the present disclosure. And, FIG. 1B is a cross-sectional side view depicting the different layers of the disclosed high power, high frequency power cable 100, in accordance with at least one embodiment of the present disclosure.

In these figures, the power cable 100 is shown to have four layers 110, 120, 130, 140. The first layer 110, located in the center of the power cable 100, is an elongated thermal conductor 110. The center elongated thermal conductor 110 may be manufactured from various different materials that are flexible, light weight, and have very high thermal conductivity. Types of materials that the center elongated thermal conductor 110 may be manufactured from include, but are not limited to, pyrolytic graphite and carbon nanotubes (CNTs). Since the center elongated thermal conductor 110 is manufactured from materials of ultra-high thermal conductivity (i.e. materials that are higher in thermal conductivity than metal conductors), the center elongated thermal conductor 110 is able to transport heat generated in the power cable 100 to at least one of the ends of the power cable 100.

In addition, in FIG. 1A, the center elongated thermal conductor 110 is shown to have a cross-sectional shape that is circular. However, it should be noted that in other embodiments, the center elongated thermal conductor 110 may be manufactured to have various different shapes other than a circular shape for its cross section including, but not limited, to a rectangular shape and a polygonic shape.

Figure 1B:
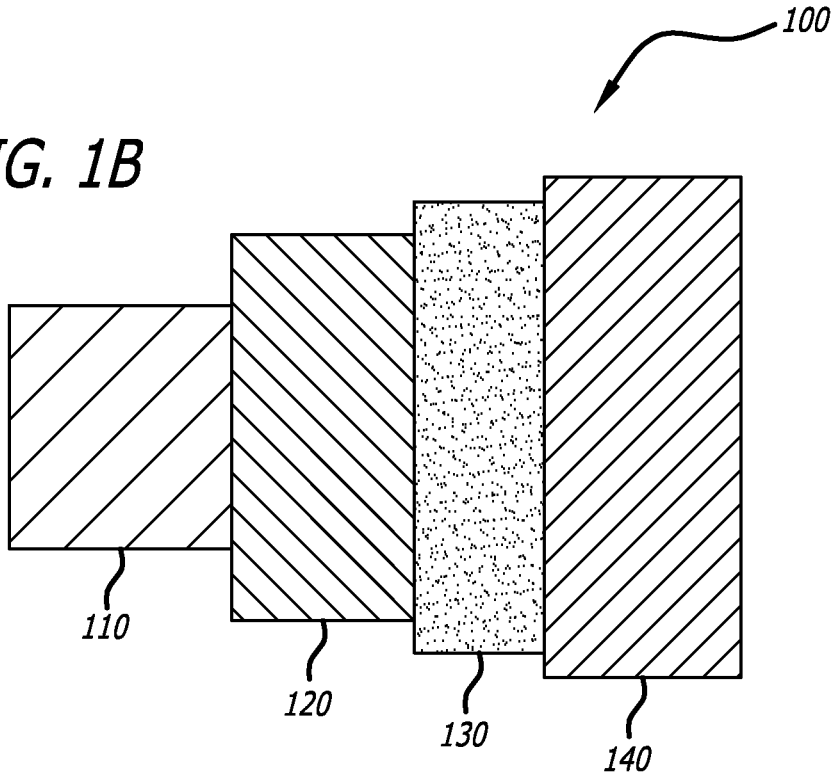
FIG. 1B is a cross-sectional side view depicting the different layers of the disclosed high power, high frequency power cable, in accordance with at least one embodiment of the present disclosure.

Also shown in FIGS. 1A and 1B, an electrical conductor layer 120 is shown to be surrounding the central elongated thermal conductor 110. The electrical conductor layer 120 may be manufactured to be one single solid or to consist of multiple strands. The electrical conductor layer 120 may be manufactured from various different conducting materials including, but not limited to, copper alloys, aluminum alloys, and a combination of copper, iron, and silver alloys.

Additionally, an electric insulation layer 130 is shown in FIGS. 1A and 1B to be surrounding the electrical conductor layer 120. The electric insulation layer 130 may be manufactured from various different kinds of insulation materials including, but not limited to, polyvinylchloride (PVC), fluoroethylenepropylene (FEP), or polytetrafluorethylene (TFE) teflon.

A thermal insulation layer 140 is shown in FIGS. 1A and 1B to be surrounding the electric insulation layer 130. The thermal insulation layer 140 is an optional layer that may be appropriate to be utilized for some applications. This optional outer thermal insulation layer 130 is used to prevent heat dissipation into ambient air through the outer surface of the power cable 100. The thermal insulation layer 140 is required when space heating is prohibited, which can be caused by heat being dissipated from the external surface of the power cable 100. When a thermal insulation layer 140 is employed by the disclosed power cable 100, the heat is solely transferred via the central thermal conductor 110. It should be noted that, in general, the thermal insulation layer 140 is not necessary since there is a convection cooling effect on the surface of the power cable 100.

Figure 2:
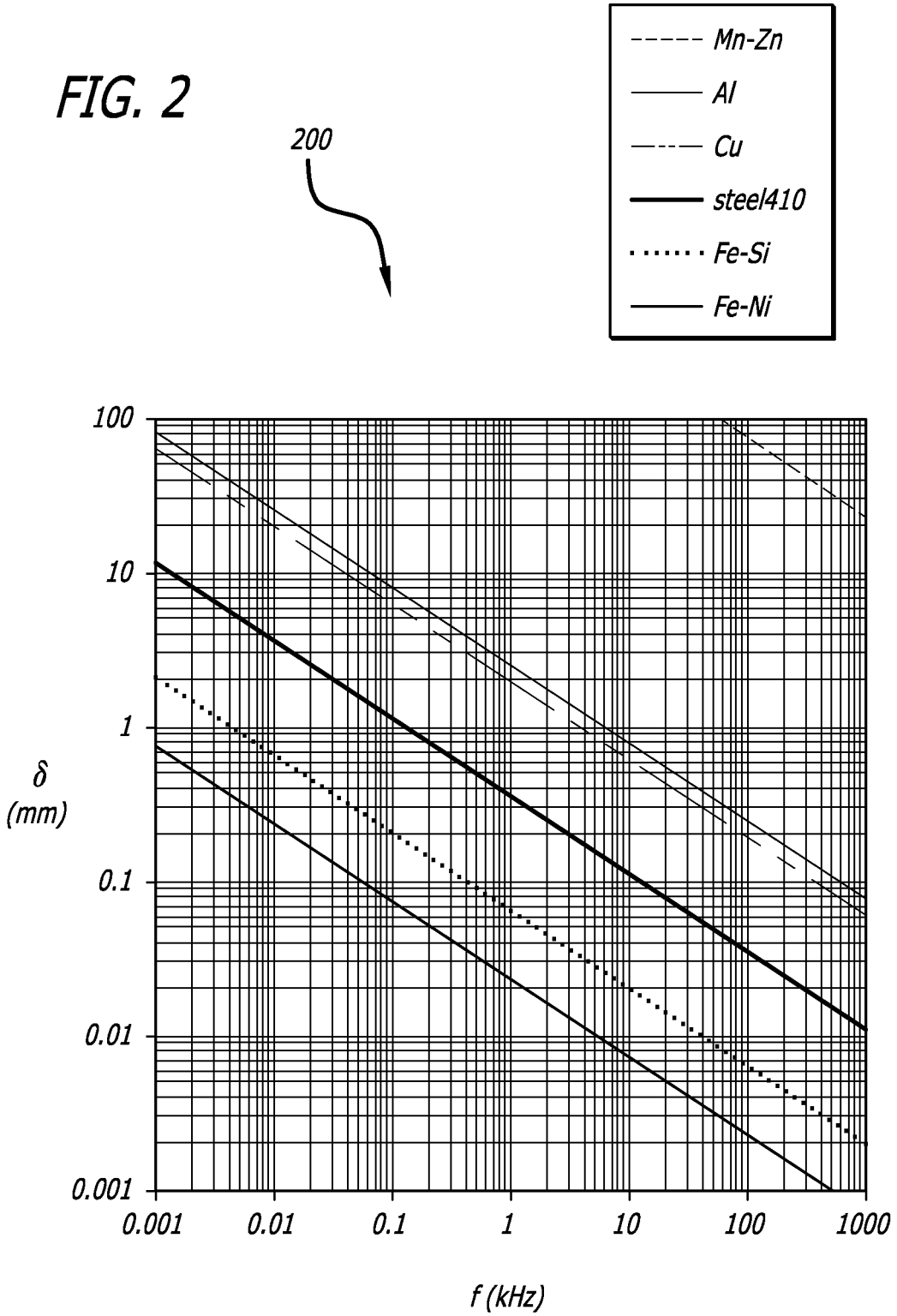
FIG. 2 is a graph providing background information for the skin depths of different conductors, which may be employed by the disclosed power cable, that are manufactured from various different materials as a function of frequency, in accordance with at least one embodiment of the present disclosure.

FIG. 2 is a graph 200 providing background information of the skin depths of different conductors, which may be employed for the disclosed power cable, that are manufactured from various different materials as a function of frequency, in accordance with at least one embodiment of the present disclosure. In this figure, the skin depth (δ) in millimeters (mm) for various different conductor materials (manganese-zinc ferrite (Mn—Zn), aluminum (Al), copper (Cu), steel 410, ferrosilicon (Fe—Si), and ferronickel (Fe—Ni)) is shown versus frequency (f) in kilohertz (kHz).

Alternating electric current (AC) has a tendency to distribute itself within a conductor such that the current density is largest near the surface of the conductor, and decreases at depths towards the interior of the conductor. The "skin depth" is defined as the distance below the outer surface of the conductor for which the electric current mainly flows (e.g., at which the current density has fallen to 1/e (about 0.37) of the current density at the surface of the conductor). As such, any conductor manufactured to be significantly thicker in depth than its skin depth is not an efficient use of that conductor material. Referring to FIG. 2, for example, the skin depth of aluminum (Al) at a frequency of 400 hertz (Hz) is about 4 mm, and the skin depth of aluminum (Al) at a frequency of 2 kHz is about 2 mm.

FIG. 3A is a schematic diagram of an exemplary design 300 for the disclosed high power, high frequency power cable, in accordance with at least one embodiment of the present disclosure. In FIG. 3A, the cable radial-direction cross-sectional view 305 is shown on the left side and the axial-direction cross-sectional view 315 is shown on the right side. Only the upper part of the half cable is shown in the axial-direction cross-sectional view 315 because (1) the cable is thermally symmetric about the mid-section plane of the cable because it is cooled at both ends, and (2) the cable is thermally symmetric about the axial centerline because of a concentric design.

In this figure, the exemplary design 300 for the disclosed power cable has a radius 350 (R3) of 13 mm. In addition, for this exemplary design 300 of the disclosed power cable, the center elongated thermal conductor has a radius 330 (R1) of 8.5 mm and is manufactured from pyrolytic graphite, which has a thermal conductivity of 1000 Watts per meter Kelvin (W/(m*K)). Also, for this power cable, the electrical conductor layer 335 has a thickness 340 (R2−R1) of 4 mm and is manufactured from aluminum, which has a typical thermal conductivity of 155 W/(m*K) and a typical electrical resistivity of $2.82e^{-8}$ ohm*meter (Ω*m). Additionally, the electric insulation layer has a thickness 350 (R3−R2) of 0.5 mm, which has a typical thermal conductivity 0.26 W/(m*K).

Also shown in FIG. 3A, boundary conditions are marked in the axial-directional cross-sectional view 315 on the power cable. the outer surface of the electric insulation layer of the power cable has natural convection cooling 360 (i.e. ambient air cooling with an ambient temperature of 300 Kelvin (K)). The heat transfer coefficient, for natural convection cooling for the surface of the power cable, is 8.5 watts per meter-squared times Kelvin ($W/m^2*K$). It is assumed that there is a resistive heating loss of 32.8 watts per meter (W/m) (i.e. 10 watts per foot (W/ft) along the length of the power cable. For this exemplary design 300 there is a cooling system (not shown) attached to both ends of the power cable to perform 300 K fixed temperature cooling 380. For this design 300, the maximum allowable temperature (i.e. maximum temperature threshold) for the power cable is 353 degrees Kelvin (K) (i.e. about 80 degrees Celsius (C)).

FIG. 3B is a schematic diagram of a conventional single solid power cable 310 showning both the radial-direction cross-sectional view 306 and the axial-direction cross-sectional view 316. Computer simulation verification was conducted for the performance of the exemplary design 300 for the disclosed high power, high frequency power cable compared to a conventional single solid conductor cable 310 under the same current carrying and cable surface cooling conditions.

In FIG. 3B, conventional power cable 310 has a radius 350 (R3) of 13 mm. The center elongated electrical conductor 355 has a radius 340 (R2) of 12.5 mm and is manufactured from aluminum, which has a typical thermal conductivity of 155 W/(m*K) and a typical electrical resistivity of $2.82e^{-8}$ ohm*meter (Ω*m). The electric insulation layer 345 has a thickness (R3−R2) of 0.5 mm, which has a typical thermal conductivity 0.26 W/(m*K). Both the conventional power cable 310 and the design 300 for the disclosed high power, high frequency power cable have the same R2 340 and R3 350. Also, they have the same thermal boundary conditions 360, 370, 390. For the conventional power cable 310, both ends of the cable are set as natural convection cooling 385. As same as in the design 300, the maximum allowable temperature (i.e. maximum temperature threshold) for the conventional power cable 310 is 353 degrees Kelvin (K) (i.e. about 80 degrees Celsius (C)).

FIG. 4 is a schematic diagram showing the simulation result of temperature distribution along the half cable of the exemplary design 300 of FIG. 3A for the disclosed high power, high frequency power cable, in accordance with at least one embodiment of the present disclosure. In this figure, a power cable 400 is shown to have its left end 410 connected to a cooling system 412. There is no heat flow across the mid-point plane 420 of the power cable. It should be noted that the power cable 400 is manufactured to the specifications of the exemplary design 300 of FIG. 3A, and has a maximum allowable temperature (i.e. maximum temperature threshold) of 353 degrees Kelvin (K) (i.e. about 80 degrees Celsius (C)) to prevent the insulation layer from heat-resulted damage.

For the power cable 400 of FIG. 4, a thermal connector 411 is connected to the central thermal conductor of the power cable 400 at an end 410 of the power cable 400. The thermal connector is connected (i.e. used as an interface) to a cooling system 412. As is shown in this figure, the end 410 of the power cable 400 that is connected to the cooling system 412 is cooled to a temperature of 300 K. And, at the mid-point 420 of the power cable 400, it is shown to exhibit temperatures from 352.4 to 353.2 K.

It should be noted that for this figure of the exemplary design, both ends of the power cable 400 are connected to cooling systems (the right end is not shown). However, for other embodiments, only one end of the power cable 400 may be connected to a cooling system. For these embodiments, the end of the power cable 400 connected to a cooling system has a thermal connector attached to the central thermal conductor of the power cable 400, and the thermal connector is attached to the cooling system.

FIG. 5 is a schematic diagram of the simulation results of the temperature distribution of the conventional power cable of FIG. 3B, where only ambient cooling is provided for the power cable 500. It should be noted that the power cable 500 has a maximum allowable temperature (i.e. maximum temperature threshold) of 353 degrees Kelvin (K) (i.e. about 80 degrees Celsius (C)) to prevent the insulation layer from heat-resulted damage.

In this figure, the power cable 500 is shown to have one of its left end 510 subjected to natural convection cooling (i.e. cooled by ambient air with a temperature of 300 K). There is no heat flow across the mid-point of the plane of the cable. Similarly, the heat transfer coefficient is 8.5 $W/(m^2*K)$ for the surface when natural convention cooling is used. As is shown in this figure, with no thermal conductor in the center of the power cable 500, the power cable 500 exhibits temperatures that range from 358.86 degrees K at its end 510 with natural convection cooling to as high as 359.8 degrees K. As such, the temperature of the power cable 500 is exceeding the maximum allowable temperature (i.e. exceeds the maximum temperature threshold) of the power cable 500 of 353 degrees K.

FIG. 6A is a cross-sectional end view depicting the different layers of another embodiment of the disclosed high power, high frequency power cable 600, in accordance with at least one embodiment of the present disclosure. And, FIG. 6B is a cross-sectional side view depicting the different layers of the disclosed high power, high frequency power cable 600 of FIG. 6A, in accordance with at least one embodiment of the present disclosure.

In these figures, the power cable 600 is shown to have five layers 610, 620, 630, 640, 650. The first layer 610, located in the center of the power cable 600, is an elongated thermal conductor 610. The center elongated thermal conductor 610 may be manufactured from various different materials that are flexible, light weight, and have very high thermal conductivity. Types of materials that the center elongated thermal conductor 610 may be manufactured from include, but are not limited to, pyrolytic graphite and carbon nanotubes (CNTs). Since the center elongated thermal conductor 610 is manufactured from materials of ultra-high thermal conductivity (i.e. materials that are higher in thermal conductivity than metal conductors), the center elongated thermal conductor 610 is able to transport heat generated in the power cable 600 to at least one of the ends of the power cable 600.

In addition, in FIG. 6A, the center elongated thermal conductor 610 is shown to have a cross-sectional shape that is circular. However, it should be noted that in other embodiments, the center elongated thermal conductor 610 may be manufactured to have various different shapes other than a circular shape for its cross section including, but not limited, to a rectangular shape and a polygonic shape.

Also shown in FIGS. 6A and 6B, an electrical conductor layer 620 is shown to be surrounding the central elongated thermal conductor 610. The electrical conductor layer 620 may be manufactured to be one single solid or to consist of multiple strands. The electrical conductor layer 620 may be manufactured from various different conducting materials including, but not limited to, copper alloys, aluminum alloys, and a combination of copper, iron, and silver alloys.

Additionally, a second thermal conductor layer 630 is shown in FIGS. 6A and 6B to be surrounding the electrical conductor layer 620. The second thermal conductor layer 630 may be manufactured from various different materials including, but are not limited to, pyrolytic graphite and carbon nanotubes (CNTs).

Also, an electric insulation layer 640 is shown to be surrounding the second thermal conductor layer 630. The electric insulation layer 640 may be manufactured from various different kinds of insulation materials including, but not limited to, polyvinylchloride (PVC), fluoroethylenepropylene (FEP), or polytetrafluorethylene (TFE) teflon.

A thermal insulation layer 650 is shown in FIGS. 6A and 6B to be surrounding the electric insulation layer 640. The thermal insulation layer 650 is an optional layer that may be appropriate to be utilized for some applications. This optional outer thermal insulation layer 650 is used to prevent heat dissipation into ambient air through the outer surface of the power cable 600.

FIG. 7A is a cross-sectional end view depicting the different layers of yet another embodiment of the disclosed high power, high frequency power cable 700, in accordance with at least one embodiment of the present disclosure. And, FIG. 7B is a cross-sectional side view depicting the different layers of the disclosed high power, high frequency power cable 700 of FIG. 7A, in accordance with at least one embodiment of the present disclosure.

In these figures, the power cable 700 is shown to have five layers 710, 720, 730, 740, 750. The first layer 710, which is located in the center of the power cable 700, is an elongated thermal conductor 710. The center elongated thermal conductor 710 may be manufactured from various different materials that are flexible, light weight, and have very high thermal conductivity. Various types of materials that the center elongated thermal conductor 710 may be manufactured from include, but are not limited to, pyrolytic graphite and carbon nanotubes (CNTs). Because the center elongated thermal conductor 710 is manufactured from materials of ultra-high thermal conductivity (i.e. materials that are higher in thermal conductivity than metal conductors), the center elongated thermal conductor 710 is able to transport heat generated in the power cable 700 to at least one of the ends of the power cable 700.

In addition, in FIG. 7A, the center elongated thermal conductor 710 is illustrated to have a cross-sectional shape that is circular. However, it should be noted that in some embodiments, the center elongated thermal conductor 710 may be manufactured to have various different shapes other than a circular shape for its cross section including, but not limited, to a rectangular shape and a polygonic shape.

Also shown in FIGS. 7A and 7B, an electrical conductor layer 720 is shown to be surrounding the central elongated thermal conductor 710. The electrical conductor layer 720 may be manufactured to be one single solid or to consist of multiple strands. additionally, the electrical conductor layer 720 may be manufactured from various different conducting materials including, but not limited to, copper alloys, aluminum alloys, and a combination of copper, iron, and silver alloys.

Additionally, an electric insulation layer 730 is shown to be surrounding the electrical conductor layer 720. The electric insulation layer 730 may be manufactured from various different kinds of insulation materials including, but not limited to, polyvinylchloride (PVC), fluoroethylenepropylene (FEP), or polytetrafluorethylene (TFE) teflon.

A shielding layer 740 is shown in FIGS. 7A and 7B to be surrounding the electric insulation layer 730. The shielding layer 740 is used to shield for electromagnetic interference (EMI) and/or current return. The shielding layer 740 may be manufactured from various different types of electrical conducting materials including, but not limited to, copper alloys, aluminum alloys, and a combination of copper, iron, and silver alloys.

In addition, a second electric insulation layer 750 is shown to be surrounding the shielding layer 740. The second electric insulation layer 750 may be manufactured from various different kinds of insulation materials including, but not limited to, polyvinylchloride (PVC), fluoroethylenepropylene (FEP), or polytetrafluorethylene (TFE) teflon.

FIG. 8 is a flow chart of the disclosed method 800 for generating specifications for a high power, high frequency power cable, in accordance with at least one embodiment of the present disclosure. At the start 810 of the method 800, requirements, conditions, and/or constraints for the power cable are provided to at least one computer 820. Requirements for the power cable include electrical requirements for the power cable, such as the power cable voltage rating in volts (V), the ampacity (I) for the power cable, and the frequency (f) of the operating alternating current (AC) of the power cable. The conditions for the power cable include the geometric parameters of the power cable, such as the cross-sectional geometry of the power cable (e.g., circular, rectangular, etc.) and the cable length (L). In addition, the conditions for the power cable include the parameters for the materials of manufacture for the power cable such as electrical conductivity ($\sigma$), thermal conductivity ($\kappa_c$), permeability ($\mu$), and the temperature coefficient of the resistivity (a) for the electrical conductor layer; the thermal conductivity ($\kappa_t$) for the thermal conductor layer; and the dielectric constant ($\in$), thermal conductivity ($\kappa_i$), and breakdown voltage ($V_b$) for the electric insulation layer. Constraints for power cable include thermal constraints for the power cable, such as the cable maximum allowable temperature ($T_{max}$, this temperature may be the maximum allowable temperature of insulation layer, or that of structure where the cable is bound on, whichever is lower), the ambient temperature ($T_a$), and the coolant temperature ($T_l$) at the end of the cable.

Constraints for the power cable also include safety constraints, such as constraints relating to specific electrical and/or thermal safety factors.

Then, at least one computer generates a set of coupled electrical-thermal steady-state algorithms for the power cable by using the provided requirements, conditions, and constraints for the power cable 830. At least one computer then calculates the manufacturing specifications for the power cable (e.g., the radiuses R1, R2, R3, etc. of the layers of the power cable) by using the set of coupled electrical-thermal steady-state algorithms for the power cable 840. After the manufacturing specifications are calculated, the method 800 ends 850. It should be noted that in alternative embodiments, standard industry software tools (e.g., finite element method based software) may be used to calculate the manufacturing specifications for the power cable.

Although certain illustrative embodiments and methods have been disclosed herein, it can be apparent from the foregoing disclosure to those skilled in the art that variations and modifications of such embodiments and methods can be made without departing from the true spirit and scope of the art disclosed. Many other examples of the art disclosed exist, each differing from others in matters of detail only. Accordingly, it is intended that the art disclosed shall be limited only to the extent required by the appended claims and the rules and principles of applicable law.

We claim:

1. A power cable apparatus, the apparatus comprising:
an elongated thermal conductor core,
wherein the elongated thermal conductor core consists of one of pyrolytic graphite or a plurality of carbon nanotubes (CNTs); and
an electrical conductor layer surrounding and in direct contact with at least a portion of an outer surface of the elongated thermal conductor core,
wherein heat generated in the power cable is transferred via the elongated thermal conductor core to at least one end of the power cable.

2. The apparatus of claim 1, wherein the apparatus further comprises an electric insulation layer surrounding at least a portion of the electrical conductor layer.

3. The apparatus of claim 2, wherein the electric insulation layer is manufactured from one of polyvinylchloride (PVC), fluoroethylenepropylene (FEP), and polytetrafluorethylene (TFE) teflon.

4. The apparatus of claim 2, wherein the apparatus further comprises a thermal insulation layer surrounding at least a portion of the electric insulation layer.

5. The apparatus of claim 2, wherein the apparatus further comprises a shielding layer surrounding at least a portion of the electric insulation layer.

6. The apparatus of claim 5, wherein the apparatus further comprises a second electric insulation layer surrounding at least a portion of the shielding layer.

7. The apparatus of claim 1, wherein the apparatus further comprises a second thermal conductor layer surrounding at least a portion of the electrical conductor layer.

8. The apparatus of claim 7, wherein the apparatus further comprises an electric insulation layer surrounding at least a portion of the second thermal conductor layer.

9. The apparatus of claim 8, wherein the apparatus further comprises a thermal insulation layer surrounding at least a portion of the electric insulation layer.

10. The apparatus of claim 1, wherein a shape of a cross section of the elongated thermal conductor core is one of circular, rectangular, and polygonic.

11. The apparatus of claim 1, wherein the elongated thermal conductor core is manufactured from a material that is flexible, light weight, and has a very high thermal conductivity.

12. The apparatus of claim 1, wherein the electrical conductor layer comprises one of a single solid and multiple strands.

13. The apparatus of claim 1, wherein the electrical conductor layer is manufactured from one of copper alloys; aluminum alloys; and a combination of copper, iron, and silver alloys.

14. The apparatus of claim 1, wherein at least one of the ends of the power cable is connected to a cooling system.

15. A system to distribute power, the system comprising:
at least one power cable, comprising:
an elongated thermal conductor core,
wherein the elongated thermal conductor core consists of one of pyrolytic graphite or a plurality of carbon nanotubes (CNTs), and
an electrical conductor layer surrounding and in direct contact with at least a portion of an outer surface of the elongated thermal conductor core,
wherein heat generated in the power cable is transferred via the elongated thermal conductor core to at least one end of the at least one power cable; and
at least one cooling system connected to at least one of the ends of the at least one power cable.

16. The system of claim 15, wherein the at least one power cable further comprises an electric insulation layer surrounding at least a portion of the electrical conductor layer.

17. The system of claim 16, wherein the at least one power cable further comprises a thermal insulation layer surrounding at least a portion of the electric insulation layer.

18. The system of claim 16, wherein the at least one power cable further comprises a shielding layer surrounding at least a portion of the electric insulation layer.

19. The system of claim 18, wherein the at least one power cable further comprises a second electric insulation layer surrounding at least a portion of the shielding layer.

20. The system of claim 15, wherein the at least one power cable further comprises a second thermal conductor layer surrounding at least a portion of the electrical conductor layer.

21. The system of claim 20, wherein the at least one power cable further comprises an electric insulation layer surrounding at least a portion of the second thermal conductor layer.

22. The system of claim 21, wherein the at least one power cable further comprises a thermal insulation layer surrounding at least a portion of the electric insulation layer.

23. A method of cooling a power cable, the method comprising:
providing, for the power cable, an elongated thermal conductor core,
wherein the elongated thermal conductor core consists of one of pyrolytic graphite or a plurality of carbon nanotubes (CNTs);
providing, for the power cable, an electrical conductor layer surrounding and in direct contact with at least a portion of an outer surface of the elongated thermal conductor core; and
transferring heat generated in the power cable via the elongated thermal conductor core to at least one end of the power cable.

* * * * *